United States Patent [19]

Wortman

[11] 4,021,871

[45] May 10, 1977

[54] PROCESS AND STRUCTURE FOR PILLOW MAKING

[76] Inventor: Harold Wortman, 5936 Monroe St., Morton Grove, Ill. 60053

[22] Filed: Oct. 20, 1975

[21] Appl. No.: 623,613

[52] U.S. Cl. ..... 5/337; 5/361 B

[51] Int. Cl.[2] ..... A47C 21/00

[58] Field of Search ..... 5/337, 338, 345 R, 355, 5/361, 361 B

[56] References Cited

UNITED STATES PATENTS

| | | | |
|---|---|---|---|
| 3,064,279 | 11/1962 | Finkle | 5/361 R X |
| 3,197,357 | 7/1965 | Schulpen | 5/361 B X |
| 3,283,345 | 11/1966 | Berck | 5/355 |
| 3,287,750 | 11/1966 | Jessup | 5/361 R X |

*Primary Examiner*—Robert L. Wolfe
*Assistant Examiner*—Andrew M. Calvert
*Attorney, Agent, or Firm*—Alter and Weiss

[57] ABSTRACT

A pillow cushion construction of foam material which has improved resilience and shape retention, and which facilitates the manufacture of pillow cushions. An upper and lower portion of the cushion provide a cavity which cooperates with a fibrous filler towards achievement of these results.

7 Claims, 9 Drawing Figures

PROCESS AND STRUCTURE FOR PILLOW MAKING

BACKGROUND OF THE INVENTION

This invention relates generally to cushioning devices and pillows and, in particular, to a foam pillow cushion construction made of foam panels and a filler between them.

Various cushion constructions have been utilized recently for the particular purposes of reducing the weight of pillows, reducing the amount of material required to make them, and increasing the amount of resilience and the cushioning capability of the pillows themselves.

The inventions of Hacklander, U.S. Pat. No. 2,878,153 as well as Wagner, U.S. Pat. No. 2,890,975 and Turck, U.S. Pat. No. 2,953,195, all disclosed methods for constructing and fabricating pillow cushion devices. In most of these devices, an internal cavity portion of the pillow was formed to contain either a sheet of different foam material, was void of any material whatsoever, or utilized the same foam material incorporated into the cushion itself. More recently, a pillow construction was disclosed by Finkel, U.S. Pat. No. 3,064,279, in which an "egg-carton" configuration was utilized, together with an interior barrier of foam material. The present invention is a viable alternative to these pillow cushion construction techniques, and offers several distinctive advantages from the disclosed art which tends to utilize foam construction within the cushion cavity. The present invention, for example, by utilizing within the cavity portion a textile fiber filler material which is fluid, rather than rigid, has the capability of being lighter in weight than the present conventional foam insert devices. Additionally, the insertion of a fiber filler can improve the cushioning effect by making more gradual the resilience of the cushion to a given load. Under compression, by utilizing the construction presently described, the egg-carton finger-like projections are kept separate since a portion of the filler is capable of wedging between them. Similarly, the sides, that is, the upper and lower portions of the pillow, are kept from sliding one against the other, since the filler material surrounds the projections, keeping them in place more effectively. There is a more uniform deformation of the pillow in all directions by utilizing the construction of the present invention, unlike the overly-rigid deformation of conventional pillows in any direction parallel to the surface of the interior foam insert. Similarly, with the present invention there is less problem in sealing the sides since the filler material can be pushed in easily, enabling the edges to make contact and be sealed. Such filler material is easier to insert between the upper and lower portions of the foam cushion, and does not have a tendency to crack, as foam does, nor to accumulate in one area of the pillow cushion, since it is maintained in place by the projecting fingers. Similarly, conventional cushions utilizing foam can often be noisy when loaded, since the friction between the insert and the projections can cause a rubbing sound.

It is thus an object of the present invention to provide a light-weight, comfortable pillow cushion which retains its shape more effectively and imparts improved cushioning resilience. It is further an object of the present invention to present facilitated construction and fabrication of such a cushion by making it easier to insert the inner cavity portion filler material.

Additionally, it is an object of the present invention to spread its cushioning features consistently in all directions within the inner cavity portion, while restraining cracking, and preventing the filler material from accumulating and becoming lumpy in one area of the pillow.

SUMMARY OF THE INVENTION

The present invention is a pillow cushion constructed of an upper and lower portion of resilient foam panels with a filler material between them. Each of these portions of foam is flat on one side and has raised projections on the other side. These raised projections give the respective sides of the upper and lower portions an egg-carton configuration which is basically an array of geometric peaks and recesses. In the pillow cushion construction of my invention, these projections, or peaks, on the upper portion directly oppose the projections or peaks on the lower portion when the two portions of the cushion are attached together at their edges by adhesive cement or heat and pressure. The pillow cushion constructed utilizes a layer of fibrous textile filler which is positioned between the projections on the upper portion and the projections on the lower portion when the upper and lower portions are joined and facing one another. This fibrous filler is thus juxtaposed to the peaks of both the upper and lower portions within the pillow as it occupies a portion of the recesses on the projecting sides of both cushion portions.

It is important to note that the most effective use of one embodiment of the invention requires that the projecting peaks on the upper portion are in alignment with the projecting peaks on the lower portion of the cushion so as to maximize the separation of the two portions while maximizing the size of the internal cushion cavity. This is of course obtained by indexing the attachment edges of the cushion so that the egg-carton configuration on each portion directly opposes the other portion at their projecting peaks.

In one particular embodiment of the invention, the edges of the upper and lower portions of the foam cushions are angularly sloped from their interior cavity side outwardly towards their respective exterior side. Attachment is achieved when these sloping edges on the upper portion are in alignmentwith the sloping edges on the lower portion so as to enable their pinching together and securement by either heat and pressure or adhesive cement. These same edges, however, could be of yet another construction so as to enable secure and effective attachment of the upper and lower portions. In this other embodiment, the edges of the upper and lower portions are substantially V-shaped appendages meeting at approximately right angles with the surface of the upper and lower portions respectively. These appendages are attached to the upper and lower portions respectively by a thin web of foam which primarily provides ease in manipulating the direction that the V-shaped edges face. When the edge of the upper portion is in alignment with the edge of the lower portion, they can thus be easily manipulated to face one another in a juxtaposed manner when pinched together and secured by heat and pressure or adhesive cement.

One embodiment of the invention provides for the peaks in the egg-carton configuration for both the upper and lower portions to be larger and taller towards the center of the cushion and smaller and shorter towards the edges of the cushion, which imparts more resilience to the center of the cushion where the greater amount of pressure will be directed.

The fibrous filler used in the internal cavity portion of the cushion comprises the conventional vegetable and synthetic materials which have substantially low density and substantially high resilience. These fillers can be seen in such examples as cotton or synthetic fibered material. The fillers further position into the internal cavity portion of the cushion to provide a substantially soft barrier between the upper and lower portions of the cushion. Thus, the filler forms a boundary between the peaks of the upper portion and the peaks of the lower portion while at the same time filling a portion of the recesses between the peaks projecting from the lower and upper portions respectively.

The pillow of the described construction is formed by (a) positioning its upper portion in proper alignment on top of the lower portion with the projections of each facing one another in an opposed fashion, (b) sealing all but one of the edges of both cushions respectively by either heat and pressure or cementing adhesive, (c) mechanically inserting into the cavity formed by the upper and lower portions the described fibrous filler material, and (d) sealing the one remaining unsealed edge by the appropriate edge-attachment means used on the other sealed edges.

DETAILED DESCRIPTION OF THE DRAWINGS

Figure 1:
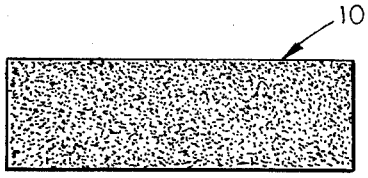
FIG. 1 is a front elevational view of the foam material from which the upper and lower portions of the cushion will be made.

While this invention is susceptible of embodiment in many different forms, there is shown in the drawings, and will herein be described in detail, only one specific embodiment with the understanding that the present disclosure is to be considered an exemplification of the principles of the invention and is not intended to limit the invention to the embodiment illustrated.

The foam material 10 from which the upper and lower portions of the pillow cushion invention are fabricated, is shown in FIG. 1 of the drawings. Both the upper portion 11 and the lower portion 12 are made from the same block of resilient foam. The manner in which the edges of the invention obtain this shape, as well as the fabrication of the fingerlike projections from this single piece of foam 10, are not disclosed in this application since irrelevant to the invention described.

Figure 3:
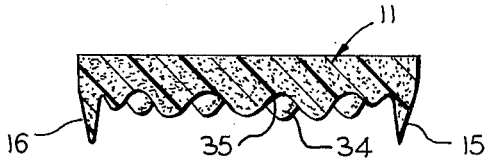
FIG. 3 is a front sectional view of the upper portion of the pillow cushion invention.
Figure 2:
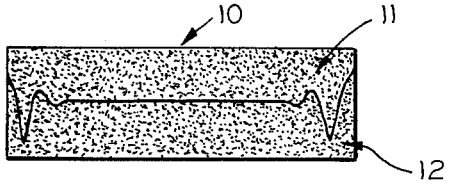
FIG. 2 is a front elevational view showing the foam of FIG. 1 after it is cut into upper and lower portions to construct the pillow cushion.
Figure 4:
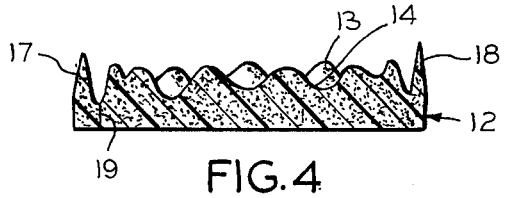
FIG. 4 is a front sectional view of the lower portion of the pillow cushion invention.

Upon separation of upper portion 11 from upper portion 12 of block of foam 10 in FIG. 2, upper portion 11 can be seen independently in FIG. 3. As can be seen, upper portion 11 has edges 15 and 16, a series of peaks, such as that shown by peak 34, and a series of recesses, as shown by recess 35, which together describe an egg-carton configuration on the bottom side of upper portion 11. Similarly, in FIG. 4 lower portion 12 has edges 17 and 18 as well as a series of peaks similar to peak 13 and a series of recesses similar to recess 14, which describe an equivalent egg-carton configuration. It should be noted that typical edge 17 on lower portion 12 can be manipulated easily since connected only by thin foam web 19.

Figure 5:
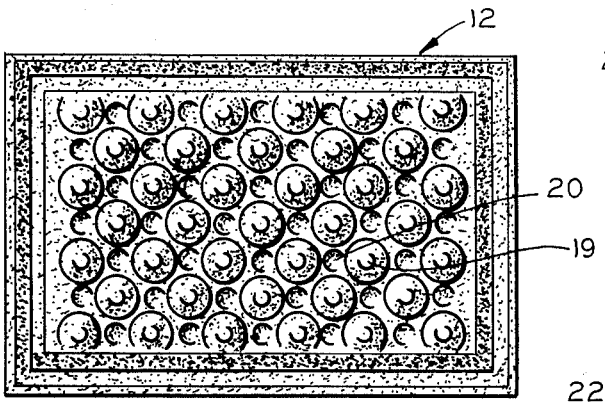
FIG. 5 is a top plan view of the lower portion of the pillow cushion invention illustrating particularly the egg-carton shape of the top side of this lower portion.

The lower portion 12 is shown in greater detail in FIG. 5, illustrating recesses, such as recess 20, and peaks, such as peak 19, which cooperate together to form a projecting geometric pattern previously described.

Figure 6:
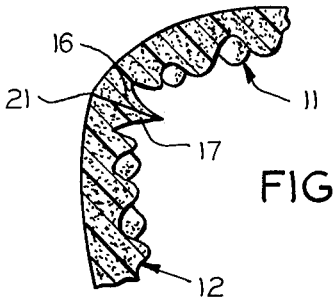
FIG. 6 is a front sectional view of the upper and lower portions intersecting for attachment.

The attachment of upper portion 11 to lower portion 12 is shown in FIG. 6, in which the two portions meet at intersection 21 at which point they are bonded together by heat and pressure or adhesive cement. With edges 16 and 17 on portion 11 and 12 respectively being easy to manipulate with little effort, both can be pinched together at intersection 21 to permit the eventual bonding operation.

Figure 7:
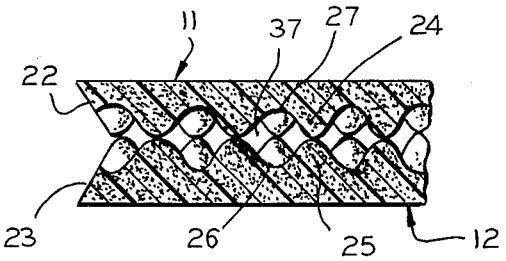
FIG. 7 is a front sectional view illustrating placement of the upper and lower portions in the pillow cushion invention.

The intersection of upper portion 11 and lower portion 12 is shown in FIG. 7, in which the two portions, 11 and 12, meet to form internal cushion cavity 37. As can be seen, the peaks on the interior surface of upper portion 11, such as peak 24, meet directly in opposition to the peaks on the lower portion 12, such as peak 25, so as to describe a maximum distance between portions 11 and 12. Similarly, recesses 26 and 27 on portions 12 and 11 respectively, assist in describing cavity portion 37 and cooperate with peaks 24 and 25 towards providing the pillow cushion with increased resilience. This opposed peak to peak arrangement can be achieved by rotating portion 11 180° relative to portion 12 from their fabricated positions as shown in FIG. 2. Also shown in FIG. 7 are edges 22 and 23, which can be utilized instead of the V-shaped appendages previously described. In using edges 22 and 23, both are pinched together and secured by edge-attachment means, such as heat and pressure or adhesive cement.

Figure 8:
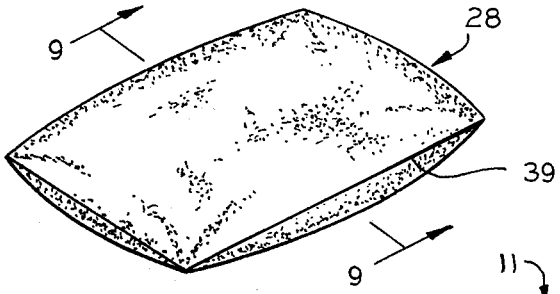
FIG. 8 is a side perspective view of the pillow cushion device following attachment of the upper and lower portions.

The entire assembled foam pillow cushion 28 is shown in FIG. 8. Seams, such as seams 39, show the attachment of the upper portion of the cushion 28 to the lower portion of cushion 28.

Figure 9:
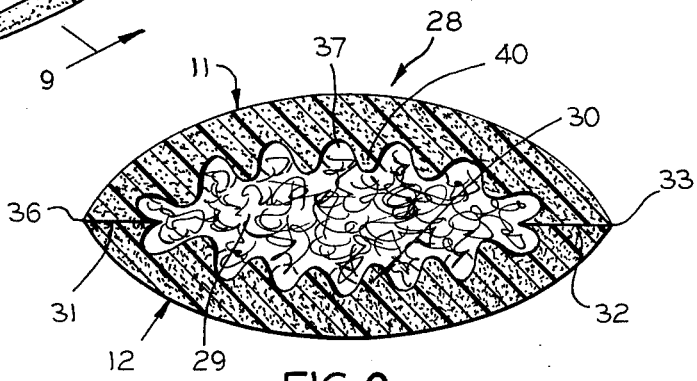
FIG. 9 is a sectional view of the entire pillow cushion invention showing the formation of an internal cavity which is filled with fibrous filler material.

A cross-sectional view of this constructed pillow cushion is shown in FIG. 9 in which cushion 28 is constructed of upper portion 11 and lower portion 12, projections 30 and 40 meeting directly so as to give body to the cushion shape and provide more resilience. Cavity portion 37 is substantially stuffed with fibrous material 29 which prevents projections 40 and 30 from slipping laterally with regard to one another and which improves the cushioning effect while decreasing the possibility of deformation of the pillow when it is loaded. Seams 31 and 32, where lower portion 12 meets upper portion 11, and final edge points 36 and 33 are similarly shown in FIG. 9. A preferred method for constructing a pillow of this design would consist of attaching all of the edges of the upper portion to the lower portion except for one, followed by the mechanical insertion of a fibrous material through this one unattached pair of edges into the pocket defined by the other attached sides, followed by the sealing of the one unattached pair of edges.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A pillow cushion construction comprising:

a plurality of resilient foam panels forming upper and lower portions of said cushion;

raised projections on one side of said upper and lower portions respectively;

said projections on said upper portion directly opposing said projections on said lower portion when said portions of said cushion are attached together at their edges by cushion attachment means; and a fibrous textile filler positioned between said opposing projections on said upper portion and said projections on said lower portion, when said edges of said cushions are joined by said cushion attachment means, said fibrous filler also occupying a position separating adjacent protrusions from one another on each of said upper and lower portions respectively, while yielding to provide an amount of interlace between said protrusions on said upper and lower portions, where said fibrous filler occupies an internal cushion cavity formed by said upper and lower portions of said cushion.

2. The invention according to claim 1 in which said projections on said upper and lower portions of said cushion, respectively, are larger and taller towards the center of said cushion and smaller and shorter towards said edges of said cushion.

3. The invention of claim 1 wherein said edges of said upper and lower portions of said foam cushions angularly slope outwardly from said side of said upper and lower portions having said projections, towards the side of said portion without said projections;

said sloping edges of said upper portion in alignment with said sloping edges of said lower portion so as to be juxtaposed to each other when pinched together and secured by said cushion attachment means.

4. The invention of claim 1 wherein said edges of said upper and lower portions comprise substantially V-shaped appendages;

said appendages attached to said upper and lower portions respectively by a foam web enabling ease in manipulation of said edge direction;

said edge of said upper portion in alignment with said edge of said lower portion so as to be juxtaposed to each other when pinched together and secured by said cushion attachment means.

5. The invention according to claim 1 where in said cushion attachment means comprises a bond between said upper and lower edges by application of heat and pressure.

6. The invention according to claim 1 wherein said cushion attachment means comprises a bond between said upper and lower edges of cementing adhesive.

7. The invention according to claim 1 wherein said fibrous fillers comprise conventional vegetable and synthetic materials having substantially low density and substantially high resilience;

said filler being positioned into said internal cavity of said cushion so as to form a substantially soft barrier between said upper and lower portions of said cushion whereby said filler forms a boundary between said projections of said upper portion and said projections of said lower portion;

said filler filling a portion of recesses between said projections from said lower portion and said upper portion of said cushion respectively.

* * * * *

UNITED STATES PATENT OFFICE

CERTIFICATE OF CORRECTION

Patent No. 4,021,871 Dated May 10, 1977

Inventor(s) HAROLD WORTMAN

It is certified that error appears in the above-identified patent and that said Letters Patent are hereby corrected as shown below:

Column 2, line 24, After "cushion" change "constructed" to read --construction--.

Column 5, line 38, Change "where" to read --whereby--.
(Claim 1)

Column 6, line 23, Change "where in" to read --wherein--.
(Claim 5)

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*